United States Patent [19]

Gwyn

[11] 4,279,734

[45] Jul. 21, 1981

[54] QUENCH PROCESS

[75] Inventor: John E. Gwyn, Katy, Tex.

[73] Assignee: Shell Oil Company, Houston, Tex.

[21] Appl. No.: 106,291

[22] Filed: Dec. 21, 1979

[51] Int. Cl.[3] ..... C10G 9/16; C10G 9/20

[52] U.S. Cl. ..... 208/48 Q; 208/102; 208/340; 208/130; 585/402; 585/539; 585/652

[58] Field of Search ..... 208/48 Q, 340, 102, 208/106; 585/539, 650, 402; 165/DIG. 12, 143

[56] References Cited

U.S. PATENT DOCUMENTS

| | | | |
|---|---|---|---|
| 3,690,839 | 9/1972 | Jones | 208/48 Q |
| 4,107,226 | 8/1978 | Ennis et al. | 208/48 Q |
| 4,150,716 | 4/1979 | Ozaki et al. | 208/48 Q |

*Primary Examiner*—Delbert E. Gantz
*Assistant Examiner*—G. E. Schmitkons

[57] ABSTRACT

A method of recovering heat energy from hydrocarbon pyrolysis effluent characterized by differentiated cooling systems, reduced coking, and high quality steam generation. Steam quality is improved by utilization of a minimum quenched effluent temperature of at least 370° C.

7 Claims, 1 Drawing Figure

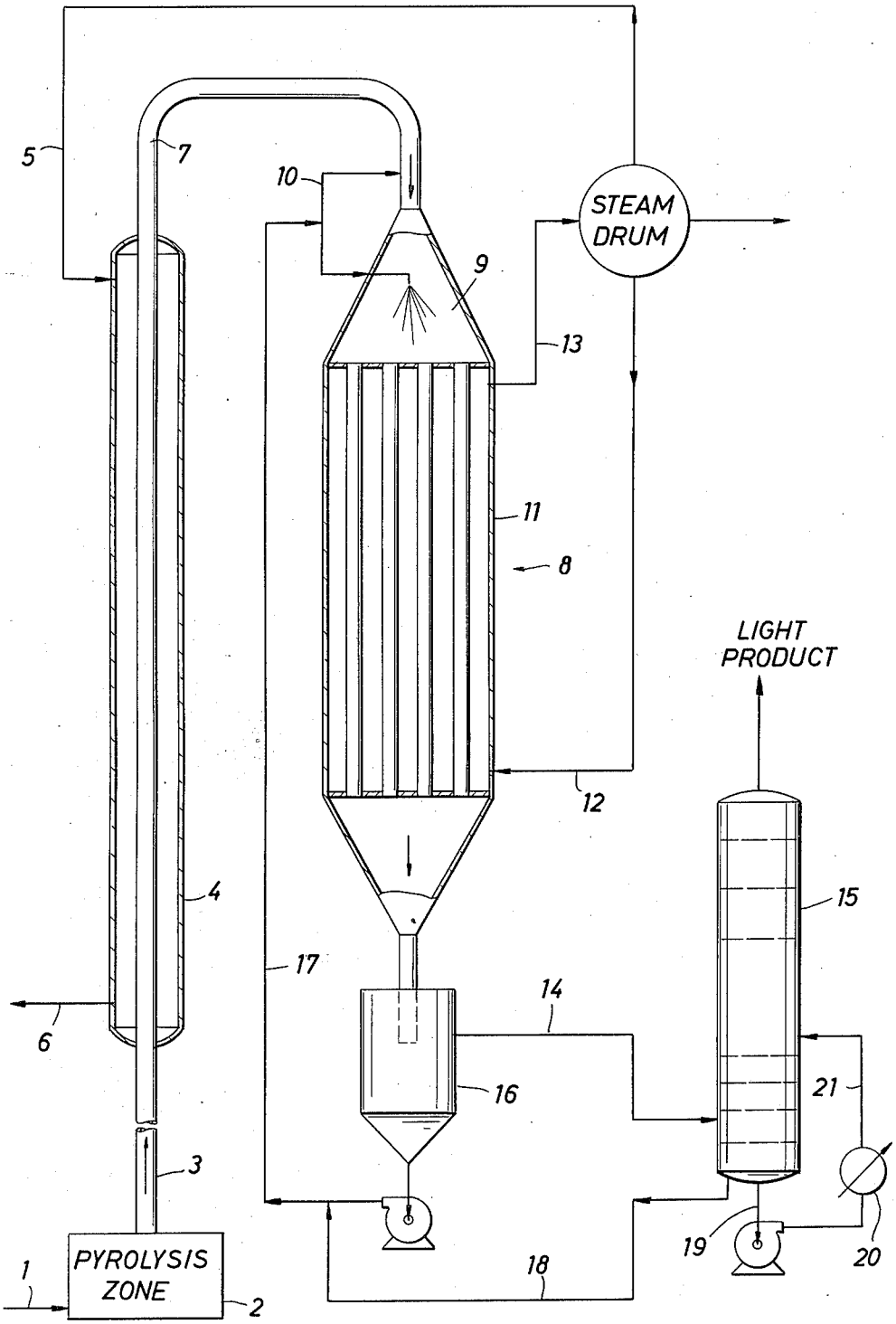
STEAM DRUM
LIGHT PRODUCT
PYROLYSIS ZONE
1
2
3
4
5
6
7
8
9
10
11
12
13
14
15
16
17
18
19
20
21

QUENCH PROCESS

BACKGROUND OF THE INVENTION

Pyrolysis of a liquid hydrocarbon material is a well-known process that involves heating the material to a temperature that is high enough to cause thermal decomposition of larger molecules to form smaller molecules. Pyrolysis may be accomplished with a diluent, such as steam, to produce more favorable product distribution. A pyrolysis process produces a highly unsaturated and very unstable product, hereinafter called the effluent from the pyrolysis process, or simply the effluent.

The effluent is usually rich in olefins, diolefins, acetylenes and other highly unstable compounds, and there is a strong tendency for these materials to react to form high molecular weight products which may be identified collectively as coke or tar. Such products are not desirable and to avoid forming them it is essential to reduce the temperature of the effluent quickly to a stable temperature, that is, to a temperature that is so low that rapid reactions of unstable compounds with each other do not take place.

In at least one process of this type, the effluent is stabilized by indirect heat exchange in stages, while in another process, the effluent is first-precooled indirectly, and then stabilized by direct heat exchange with a liquid quench. In the latter process, the bulk of the heat absorbed by the quench liquid is removed in the later fractional distillation of the effluent and quench liquid, a significant portion of the heat removal being accomplished by separation of a bleed stream, heat exchange of the stream, and return of at least a portion of the bleed stream to the fractional distillation zone. This procedure, however, suffers from the deficiency that only low pressure steam may be generated, as well as requiring a large volume of bleed.

Great Britain Pat. No. 1,503,871, (corresponds to U.S. Pat. No. 4,150,716) describes a process in which the effluent is quenched at temperatures of up to 400° C., the effluent and quench liquid contacting the walls of a shell and tube exchanger to generate high pressure steam. However, this procedure also does not utilize efficiently the high quality energy present in the pyrolysis effluent. Accordingly, a need has existed for a process that lessens coking problems while providing efficient heat energy recovery. The invention satisfies that need.

SUMMARY OF THE INVENTION

Accordingly, the invention, in one embodiment, relates to a method for recovering heat energy from the effluent of a hydrocarbon pyrolysis reactor comprising passing the effluent from a pyrolysis unit through a first indirect heat exchange pre-quench zone to lower the temperature of the effluent and produce a pre-cooled effluent having a temperature not less than about 540° C., and high pressure steam;

passing the pre-cooled effluent at a temperature of not less than about 540° C. to a quench zone comprising a moderator section communicating with a liquid quench section, and contacting the pre-cooled effluent first in the moderator section with a suitable quench liquid to cool the pre-cooled effluent and produce an effluent-quench liquid mixture having a temperature not less than about 400° C., and then passing the effluent quench liquid mixture to an indirect heat exchange section of the quench zone, the heat exchange section providing heat transfer to water to form high pressure steam, and producing a quenched effluent and quench liquid mixture having a temperature of at least 370° C.;

passing quenched effluent and quench liquid mixture as a feed to a fractional distillation zone, and fractionally distilling the feed;

continuously removing a bleed stream from the lower portion of the fractional distillation zone, passing the bleed stream to a heat exchange zone and recovering heat from the bleed stream, and producing a cooler bleed stream, and returning at least a portion of the cooler bleed stream to the fractional distillation zone.

In another embodiment, at least a portion of the quench liquid is separated from the quenched effleunt and quench liquid mixture. Preferably, the portion separated is returned to the upper portion of the quench zone.

As used herein, the term "indirect", as applied to heat exchange methods, implies that the medium to which heat is initially principally transferred does not contact the higher energy level material, heat transfer being accomplished through an intermediate medium such as a tube wall or other barrier.

Although the invention is adaptable to the treatment of pyrolysis product effluents of any hydrocarbon material, it is particularly suited for utilization with effluents produced from heavier hydrocarbon material. Preferred feedstocks include gas oil and pitch. The particular procedure employed in the pyrolysis of the hydrocarbon feed forms no part of the invention, and any suitable method that produces a high temperature effluent may be employed.

As indicated, the temperature of the effluent from the pyrolysis unit will normally exceed 760° C. Temperatures on the order of from 780° C. to 800° C. are common for pyrolysis of gas oils in conventional units, and temperatures of 815° C. to 925° C. are employed for high temperature, short contact time pyrolysis. In accordance with the invention, the effluent will first be contacted in a pre-quench zone to lower the temperature of the effluent to a range of from about 650° C. to 540° C., preferably not below 590° C. This high quality energy present may be utilized, by indirect heat exchange, for any heating desired, and, in particlar, the production of high pressure steam.

An important feature of the invention is the concept of limited heat exchange in the pre-cooling zone. In order to minimize coking, heat exchange is regulated in such a manner that, while valuable heat is recovered, the effluent is not cooled to such an extent that coking occurs. Thus, heat exchange is limited so that the temperature of the effluent, after indirect heat exchange with the heat exchange medium in the pre-cooling zone, does not approach the temperature of the incoming heat exchange medium. This "limited" exchange, in conjunction with the quenching procedures described herein, permits recovery of valuable heat energy with minimal coking.

Mechanically, the limited surface exchanger represents the simplest design. For example, tube in tube heat exchangers are particularly suitable. Performance may be maintained by extending the length of the exchanger tubes. Caution must be exercised that the cooler end of the tube will not stay at a low enough temperature that coking will plug the tube.

The partially cooled effluent, with a significant heat content extracted, is passed to a quench zone. The quench zone contains a continuous wet film quench unit similar to that descirbed in U.S. Pat. No. 3,907,661 to Gwyn, Baldwin, and Brodhead, issued Sept. 23, 1975. However, because the invention aims at enhanced heat recovery, several modifications of the procedure of U.S. Pat. No. 3,907,661 are required.

As noted, the effluent is cooled in the quench zone to a temperature not lower than about 370° C. This is accomplished by suitable quench liquid temperature and volume, and by appropriate design of the quench zone. In particular, the quench zone is divided into two principal sections, a moderator section and an indirect heat exchange section. In the moderator section, the pre-cooled effluent is contacted with a suitable quench liquid in such quantity as to drop the temperature of the effluent to a temperature not below about 400° C. This temperature, depending on the nature of the liquid, will normally be in the range of 400° C. to 500° C., preferably 400° C. to 475° C. Any quench liquid vaporized will function as a temperature moderator in the zone. Preferably, the quench liquid will be sprayed into the effluent, this procedure having the advantage of wetting the walls of the moderator zone and inhibiting coking therein. Additionally, the quench liquid in the effluent-quench liquid mixture advantageously provides liquid for wetting the walls of the heat exchange section of the quench zone and inhibiting coking thereon. The ratio of quench liquid to effluent is varied to provide the temperatures desired, a ratio of about two parts quench liquid to one part effluent, on a weight basis, being acceptable.

As indicated, the moderator section communicates with an indirect heat exchange section. The quench liquid-effluent mixture passes from the moderator section into this section, where it is cooled to a final temperature not lower than about 370° C. Preferably, a shell and tube configuration is employed, high pressure water being brought into indirect heat exchange with the quench liuqid effluent mixture for recovery of high pressure steam. Additional quench liquid may be added to ensure a continuous film on the exchanger walls. By maintaining conditions to produce a quenched effluent (heat exchanger outlet) temperature of at least 370° C., the high quality energy present in the effluent may be effectively recovered. Quenched effluent temperatures of 425° C. to 400° C. are preferred.

The quench liquid employed may vary in composition, subject to the requirement that it does not completely vaporize at the temperatures employed for quenching and the unvaporized portion remains liquid. Suitable hydrocarbonaceous liquids must be compatible with the effluent, and normally will include such highly aromatic liquids as aromatic residual oils, gas oils, etc. Fractionator bottoms may be used, and pyrolysis pitch represents a preferred material. Those skilled in the art, given the requirements set forth herein, may select the appropriate quench liquid with little difficulty.

After quenching, the pyrolysis effluent still retains significant quantities of heat which may be utilized. This heat may be utilized in the fractional distillation of the effluent, or in other uses. According to the invention, the effluent is passed to a fractional distillation zone for separation of the effluent into desired products. Prior to the entry into the fractional distillation zone, the quench liquid (or a portion thereof) may be separated from the effluent, or the effluent and quench liquid (or a portion thereof) may be cooled by heat exchange, as desire. Preferably, the effluent and a portion of the quench liquid sufficient to maintain wetted transfer line walls are forwarded directly to the fractional distillation zone. Procedures employed in fractionating such effluents are known in the art, and form no part of the invention.

If the effluent has been sent to the fractionation unit without cooling, the quantity of heat supplied to the fractionation unit will be too great, and will not permit proper operation of the unit unless appropriate measures are taken. Accordingly, the invention provides that a bleed stream of liquid is removed from the lower portion of the fractional distillation zone, the stream is subjected to heat exchange, preferably indirectly with water, and the cooled stream is returned to the fractionation unit. The heat is thus recovered, as desired, preferably as low temperature steam. Accordingly, the invention provides effective recovery of heat energy present in the pyrolysis effluent. Additionally, the amount of quench liquid required is reduced by use of the pre-cooling zone, and the pressure drop in the quench zone heat exchanger is also reduced.

In order to explain the invention more fully, reference is made to the accompaying drawing. Values in this illustration are calculated.

Gas oil is introduced via line 1 into a high temperature pyrolysis zone 2 and thermally cracked to form an effluent containing olefins. Temperatures in the cracking unit 2 will range from 540° C. to 800° C. and will produce an effluent leaving the reaction having a temperature of from 780° C. to 800° C. The effluent is passed via duct or line 3 into pre-quench heat exchange zone 4. Pre-quench zone 4 comprises a limited surface heat exchanger such as a tube-in-tube heat exchanger. Steam at high pressure is employed as coolant, and, as shown in the drawing, may be introduced via line 5 at the cooler end of exchanger 4. High temperature steam is recovered at the hotter end of heat exchanger 4 via line 6. In exhanger 4, the temperature of the effluent is reduced to 595° C., while generating high pressure steam at 650° C. and 100 atmospheres.

From unit 4, the effluent passes through line or duct 7 to quench zone 8. The effluent is contacted in the moderator section 9 of the quench zone 8 with quench liquid from line 10, preferably sprayed in as shown. Preferably, a segment of line 10 provides quench liquid for wetting the walls of duct 7. The temperature of the effluent quench liquid mix is lowered in moderator section 9, to approximately 450° C.

From section 9, the effluent-quench liquid mixture passes through tube in shell exchanger 11, where heat exchange is maintained by indirect contact through the tube walls with high pressure water entering via line 12 and exiting via line 13. Upon passing through the tube section, the temperature of the effluent-quench liquid mixture is lowered to a temperature not lower than about 370° C. Simultaneously, the heat exchange produces steam at about 315° C. in line 13. Steam in line 13 goes to a steam drum, where it may be forwarded to further use, e.g., via line 5, and water is recycled via line 12 to the exchanger of unit 8.

From quench zone 8, the effluent is passed via line 14 to fractionation zone 15. Preferably, provision is made for removal of and recycle of a portion of the quench liquid prior to entry into the fractionation column. As shown in the drawing, a knockout drum 16 cooperates with the bottom of unit 8 to remove a quantity of quench liquid from the effluent-quench liquid mixture. From knockout drum 16, the quench liquid is recycled, via line 17, through lines 10.

In fractional distillation column 15 the effluent is separated into the desired fractions. Olefins, i.e., ethylene, and propylene, are separated from the upper portions of the column, while bottoms or other fractions may be removed and returned via line 18 for use as the quenching liquid. Column control, per se, including reflux, forms no part of the invention, and is within the skill of the art.

In accordance with the invention, however, a bleed stream is withdrawn via line 19 and passed to heat exchange unit 20. Heat exchange unit 20 is preferably a water, shell and tube exchanger. Steam is generated for useful applications, and at least a portion of the cooled bleed stream is returned via line 21 to fractional distillation column 15. The amount of bleed and return are regulated, in conjunction with quench liquid recycle, and column reflux, to provide efficient fractionation and effective utilization of the heat in the quenched pyrolysis effluent.

While the invention has been illustrated with respect to particular apparatus, those skilled in the art will appreciate that other equivalent or analogous units may be employed. Again all pumps, valves, entry and exit lines, etc. have not been illustrated, as such expedients can readily be suppled by the skill of the art.

What is claimed is:

1. A method for recovering heat energy from the effluent of a hydrocarbon pyrolysis reactor comprising passing the effluent through a first indirect heat exchange pre-quench zone to lower the temperature of the effluent and produce a pre-cooled effluent having a temperature not less than about 540° C., and high pressure steam;

passing the pre-cooled effluent at a temperature of not less than about 540° C. to a quench zone comprising a moderator section communicating with a liquid quench section, and contacting the pre-cooled effluent first in the moderator section with a suitable quench liquid to cool te pre-cooled effluent and produce an effluent-quench liquid mixture having a temperature not less than about 400° C., and then passing the effluent quench liquid mixture to an indirect heat exchange section of the quench zone, the heat exchange section providing heat transfer to water to form high pressure steam, and producing a quenched effluent and quench liquid mixture having a temperature of at least 370° C.;

passing quenched effluent and quench liquid mixture as a feed to a fractional distillation zone, and fractionally distilling the feed;

continuously removing a bleed steam from the lower portion of the fractional distillation zone, passing the bleed stream to a heat exchnge zone and recovering heat from the bleed stream, and producing a cooler bleed stream, and returning at leat a portion of the cooler bleed stream to the fractional distillation zone.

2. A method for recovering heat energy from the effluent of a hydrocarbon pyrolysis reactor comprising passing the effluent through a first indirect heat exchange pre-quench zone to lower the temperature of the effluent and produce a pre-cooled effluent having a temperature of not less than about 540° C.; and high pressure steam;

passing the pre-cooled effluent at a temperature of not less than about 540° C. to a quench zone comprising a moderator section communicating with a liquid quench section, and contacting the pre-cooled effluent first in the moderator section with a suitable quench liquid to cool the pre-cooled effluent and produce an effluent-quench liquid mixture having a temperature not less than about 400° C., and then passing the effluent quench liquid mixture to an indirect heat exchange section of the quench zone, the heat exchange section providing heat transfer to water to form high pressure steam, and producing a quenched effluent and quenched liquid mixture having a temperature of at least 370° C.;

separating at least a portion of the quench liquid from the quenched effluent and quench liquid mixture, and passing said portion to the upper portion of the quench zone;

passing the quenched effluent and remaining quench liquid, if any, as a feed to a fractional distillation zone, and fractionally distilling the feed;

continuously removing a bleed stream from the lower portion of the fractional distillation zone, passing the bleed stream to a heat exchange zone and recovering heat, from the bleed stream, and producing a cooler bleed stream, and returning at least a portion of the cooler bleed stream to the fractional distillation zone.

3. The method of claim 2 wherein the quenched effleunt and remaining quench liquid, if any, are cooled prior to entry into the fractional distillation zone.

4. The method of claim 1 wherein the quench liquid is a hydrocarbonaceous liquid.

5. The method of claim 2 wherein the quench liquid is a hydrocarbonaceous liquid.

6. The method of claim 1 wherein the quench liquid is pitch.

7. The method of claim 2 wherein the quench liquid is pitch.

* * * * *